United States Patent [19]

Hess et al.

[11] Patent Number: 5,030,142

[45] Date of Patent: Jul. 9, 1991

[54] MULTICONNECTION PLUG AND SOCKET

[75] Inventors: Gottfried Hess, Pfullingen; Werner Hofmeister, Mühlacker, both of Fed. Rep. of Germany

[73] Assignee: Robert Bosch GmbH, Stuttgart, Fed. Rep. of Germany

[21] Appl. No.: 458,667

[22] PCT Filed: Jul. 19, 1988

[86] PCT No.: PCT/DE88/00446

§ 371 Date: Jan. 10, 1990

§ 102(e) Date: Jan. 10, 1990

[87] PCT Pub. No.: WO89/01247

PCT Pub. Date: Feb. 9, 1989

[30] Foreign Application Priority Data

Aug. 3, 1987 [DE] Fed. Rep. of Germany ..... 3725668

[51] Int. Cl.[5] ..... H01R 13/436

[52] U.S. Cl. ..... 439/752

[58] Field of Search ..... 439/752, 733

[56] References Cited

U.S. PATENT DOCUMENTS

| | | | |
|---|---|---|---|
| 4,082,400 | 4/1978 | Gansert | 439/752 |
| 4,113,333 | 9/1978 | Horowitz | 439/752 |
| 4,284,320 | 8/1981 | Nix et al. | 439/752 |
| 4,915,654 | 4/1990 | Zinn | 439/752 |

FOREIGN PATENT DOCUMENTS

| | | | |
|---|---|---|---|
| 177810 | 4/1986 | European Pat. Off. . | |
| 214794 | 3/1987 | European Pat. Off. . | |
| 3023313 | 1/1982 | Fed. Rep. of Germany | 439/752 |
| 3330151 | 3/1985 | Fed. Rep. of Germany | 439/752 |
| 3441559 | 5/1986 | Fed. Rep. of Germany . | |

*Primary Examiner*—Gary F. Paumen

*Attorney, Agent, or Firm*—Michael J. Striker

[57] ABSTRACT

A multicontact plug and socket is suggested which comprises a plug strip (2) with flat plug-in contacts (3) and a socket (1) with assigned flat contact receptacles (11) which are arranged in parallel chambers (8) of a contact carrier (5, 6, 7) and extend through assigned openings (10) of a safety plate (9) which is arranged so as to be displaceable in the contact carrier (5, 6, 7) in order to lock the contact receptacles (11). A catch tongue (15) of every contact receptacle (11) engages at the plate side (21) facing in the plug-in direction of the socket (1) in the unlocking position of the plate (9), while edge areas (20; 47, 48) of the opening (10) of the plate (9) contact portions of the edge (16) of the box-shaped portion (13) of the contact receptacles (11) with the plate side (21) in the locking position of the plate (9).

7 Claims, 4 Drawing Sheets

MULTICONNECTION PLUG AND SOCKET

BACKGROUND OF THE INVENTION

The invention relates to a multiconnection. In a known plug and socket, the flat contact receptacles, which are arranged in three parallel rows in a contact carrier, engage with a catch tongue behind a catch edge of the contact carrier in the unlocking and locking positions of a locking plate. In the locking position of the plate, the flat contact receptacles are additionally secured by means of the plate. A disadvantage consists in that a complicated injection molding tool with telescoping needles is required for producing the catch edge and accordingly the contact carrier, the catch edge being constructed as an undercut. Such complicated tools require repairs to a relatively great extent.

Moreover, there is an increasing need for a plug and socket in which 50 or more individual plug-in connections are comprised and which can be plugged in or unplugged at once. It is a disadvantage that the plug and socket requires more and more space which is very limited chiefly in the installation space of motor vehicles.

SUMMARY OF THE INVENTION

The invention has the object of providing a multiconnection plug and socket which can be produced with simple tools and can be provided with smaller plug-in connection parts in order to save space.

It is advantageous that the contact carrier can receive more connection parts in the form of smaller box-shaped flat contact receptacles while retaining the same dimensions and in so doing makes do with spring contact chambers having smooth walls, but a smaller cross section. The spring contact chambers, and accordingly the contact carriers, can be produced more easily and with simpler tools. Such tools are substantially less needful of repairs and are suitable for economical large-series production. Moreover, the plugs can be used for a plug and socket with the desired number of connection parts simply by exchanging the contact carrier. Moreover, the flat contact receptacles can be held and secured in the contact carrier in their unlocking and locking positions solely by means of the safety plate.

It is particularly advantageous to provide the openings of the safety plate with projections and/or to use edge portions of the openings in such a way that the catch tongues and/or parts of the edge of the box-shaped portion of the flat contact receptacles contact the side of the safety plate facing in the plug-in direction in the unlocking and/or locking positions of the plate.

Moreover, a substantial advantage consists in that a mixed outfitting with larger and smaller socket parts for the multiconnection plug and socket is possible. For this purpose, the socket parts need not be ordered only in rows according to size. Larger and smaller socket parts can also be arranged in a mixed manner in one or more rows.

BRIEF DESCRIPTION OF THE DRAWING

Embodiment examples of the invention are shown in the drawing and explained in more detail in the following description.

DESCRIPTION OF THE PREFERRED EMBODIMENTS

Figure 1:
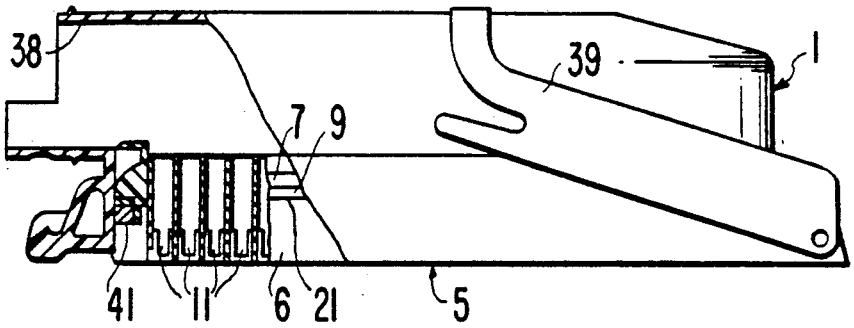
FIG. 1 shows a front view of a socket of a multiconnection plug and socket, partially in longitudinal section.

A multiconnection plug and socket (FIG. 9) has a socket 1 and a plug strip 2 which is provided with flat plug-in contacts 3 and is arranged at the cover 4 of an electrical switching device not shown in more detail.

Referring to FIGS. 1–7, the socket 1 in a first embodiment example has a contact carrier 5 of insulating plastic. The contact carrier 5 having substantially rectangular cross section is assembled of a lower part 6 and an upper part 7. The parts 6 and 7 are connected with one another so as to be detachable in a manner known per se and not described in more detail. Three rows of a plurality of flat chambers 8 lying parallel to one another are constructed in the contact carrier 5. A safety plate 9 is arranged between the lower and upper parts 6, 7 so as to be displaceable transversely relative to the rows of the chambers 8. The plate 9 has openings 10 corresponding to the cross-sections of respective chambers 8 in the region between the lower and upper parts 6 and 7.

In the first embodiment example of the contact carrier 5, according to FIGS. 1 to 7, small flat contact receptacles 11, so-called micro-timers, are used. The flat contact receptacles 11 have a contact portion with two spring arms 12. A box-shaped portion 13 whose cross-section is adapted to the plate opening 10, adjoins the contact portion 12. A catch tongue 15 is formed at an angle on a wall 14 of the portion 13 extending parallel to the spring arms 12. The free end of the catch tongue 15 projects somewhat over the edge 16 of the box-shaped portion 13. A necked-down locking portion 17 of the flat contact receptacle 11 adjoins the edge 16 of the box-shaped portion 13. An inner clamping portion 18 for the bare end of an electrical line, known per se and not shown in more detail, adjoins the locking portion 17. The inner clamping portion 18 passes into an outer clamping portion 19 which is clamped at the end portion of the insulation of the electrical line, not shwon, in a manner known per se.

Figure 2:
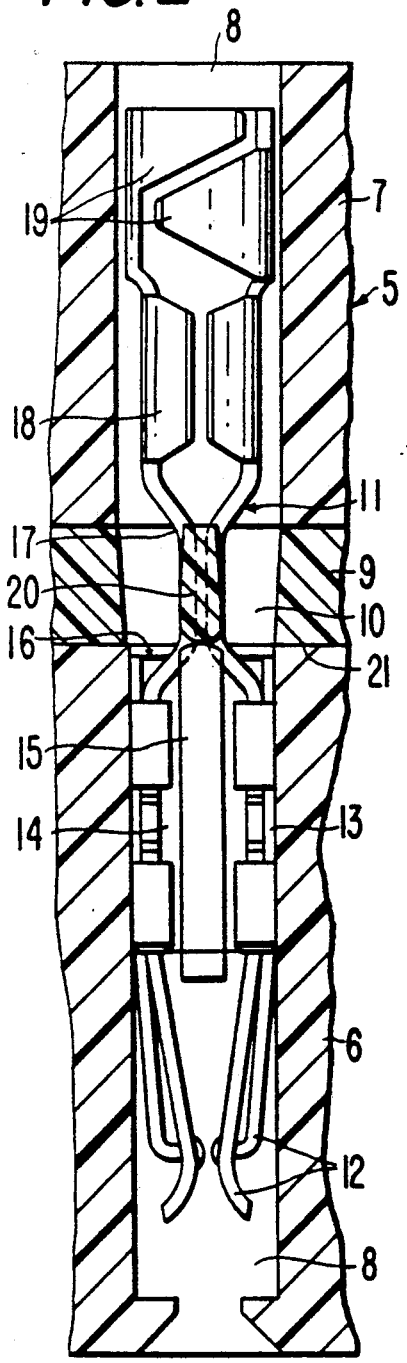
FIG. 2 shows on an enlarged scale a sectional front view of a contact chamber with a flat contact receptacle of a first embodiment example of the contact carrier in the unlocking position of the safety plate.
Figure 3:
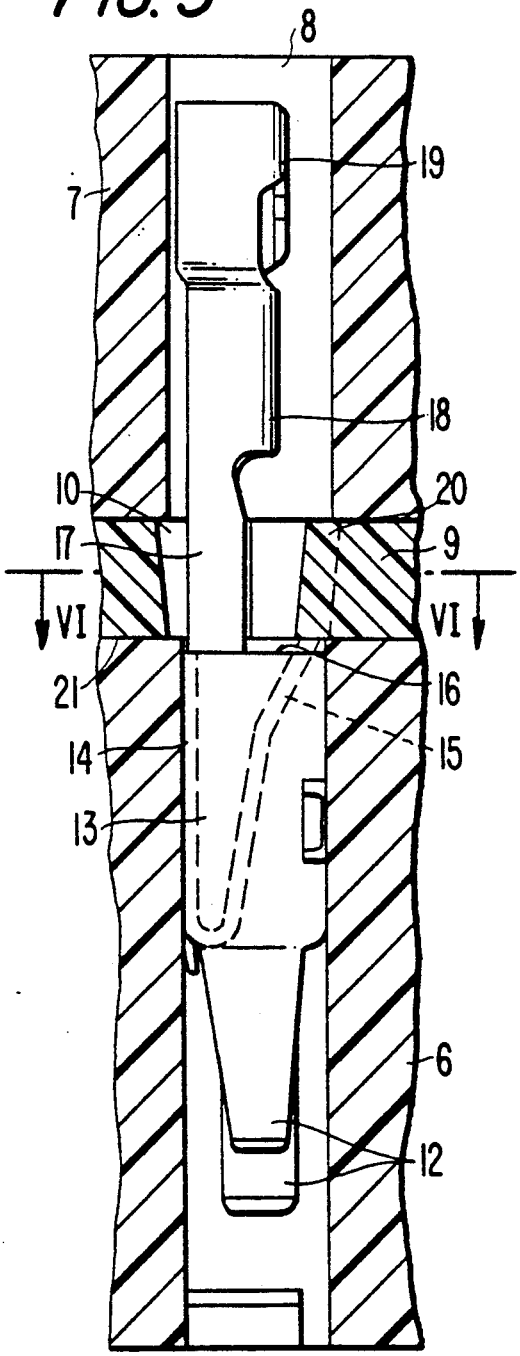
FIG. 3 shows a sectional side view of the contact chamber of FIG. 2.
Figure 6:
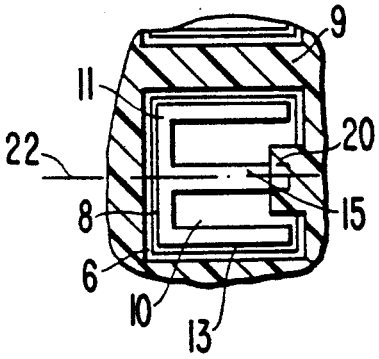
FIG. 6 shows a section along line VI—VI in FIG. 3 in a simplified view.

FIGS. 2, 3 and 6 show the assembly position of the socket 1 in which the flat contact receptacles 11, which are clamped at the assigned ends of electrical lines and constructed as micro-timers, are inserted into the assigned flat chambers 8. Every flat contact receptacle 11 is pushed through the upper part 7 and the corresponding opening 10 in safety plate 9 into the lower part 6 until the spring arms 12 and the box-shaped portion 13 are completely received in the lower part 6. The necked-down locking portion 17 then extends through the opening 10 of the plate 9, while the clamping portions 18 and 19 are situated in the upper part 7 of the contact carrier. The openings 10 of the plate 9 delimit a locking projection 20 which projects into the assigned chamber 8, the catch tongue 15 engages behind the projection 20 when the flat contact receptacle 11 is correctly inserted into the chamber 8 of the contact carrier 5. The flat contact receptacles 11 are then held in the contact carrier 5. The catch surface of the projection lies in a common plane with the side 21 of the plate 9 which is facing in the plug-in direction of the socket and is shown in the drawing as the lower side. The plate side 21 constantly contacts the lower part 6 of the contact carrier 5. The center line of a row of the chambers 8 with flat contact receptacles 11—in this case, micro-timers—is designated by 22 in FIG. 6, one chamber 8 is shown with a flat contact receptacle 11 and a portion of the plate 9 surrounding it.

Figure 4:
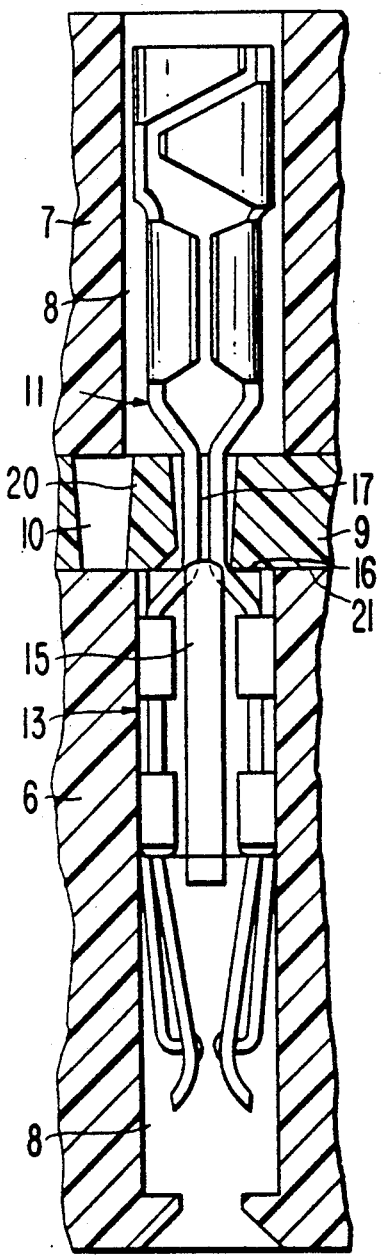
FIG. 4 shows the contact chamber of FIG. 2 in the locking position of the safety plate.
Figure 5:
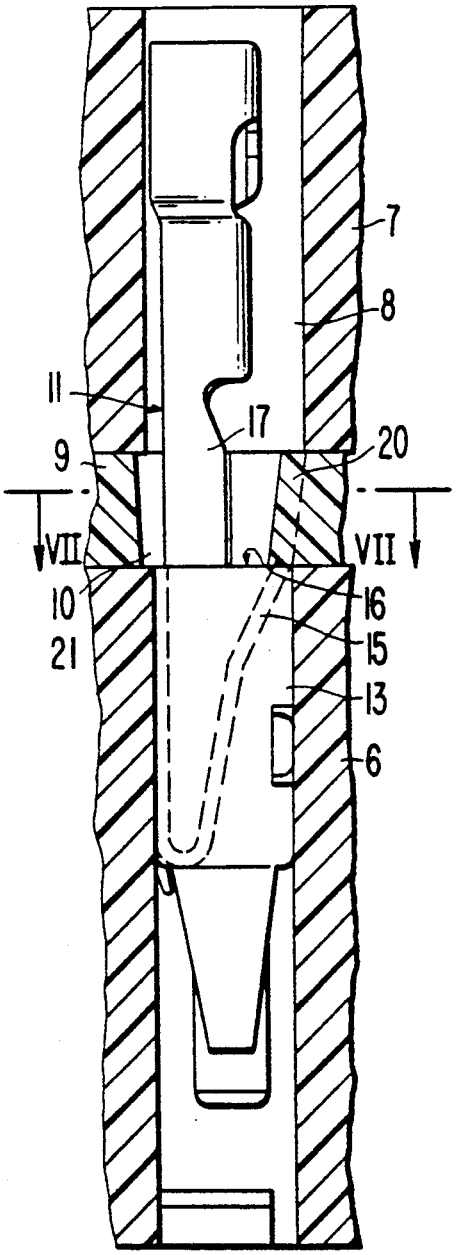
FIG. 5 shows the contact chamber of FIG. 4 as seen from the side.
Figure 7:
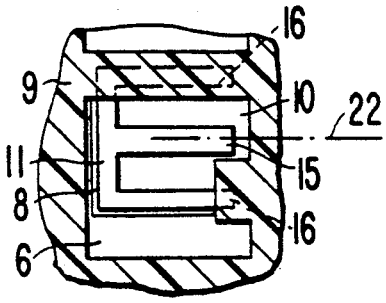
FIG. 7 shows a section along line VII—VII in FIG. 5 in a simplified view.

When all flat contact receptacles 11 are inserted into the chambers 8 and engaged with their catch tongues 15 behind the projections 20 at the plate side 21, the plate 9 is pushed transversely relative to the center line 22 of the row of flat contact receptacles 11—only one of which is shown—into the locking position shown in FIGS. 4, 5 and 7 for further assembly of the socket 1. The side 21 of plate 9 then lies on a portion of the upper edge 16, and the projection 20 of the plate 9 releases the catch tongue 15 and then lies on another portion of the edge 16 of the box-shaped portion 13 of the flat contact receptacle 11. The side 21 contacts oppositely located portions of the edge 16 in order to prevent a tilting of the flat contact receptacle 11.

Figure 8:
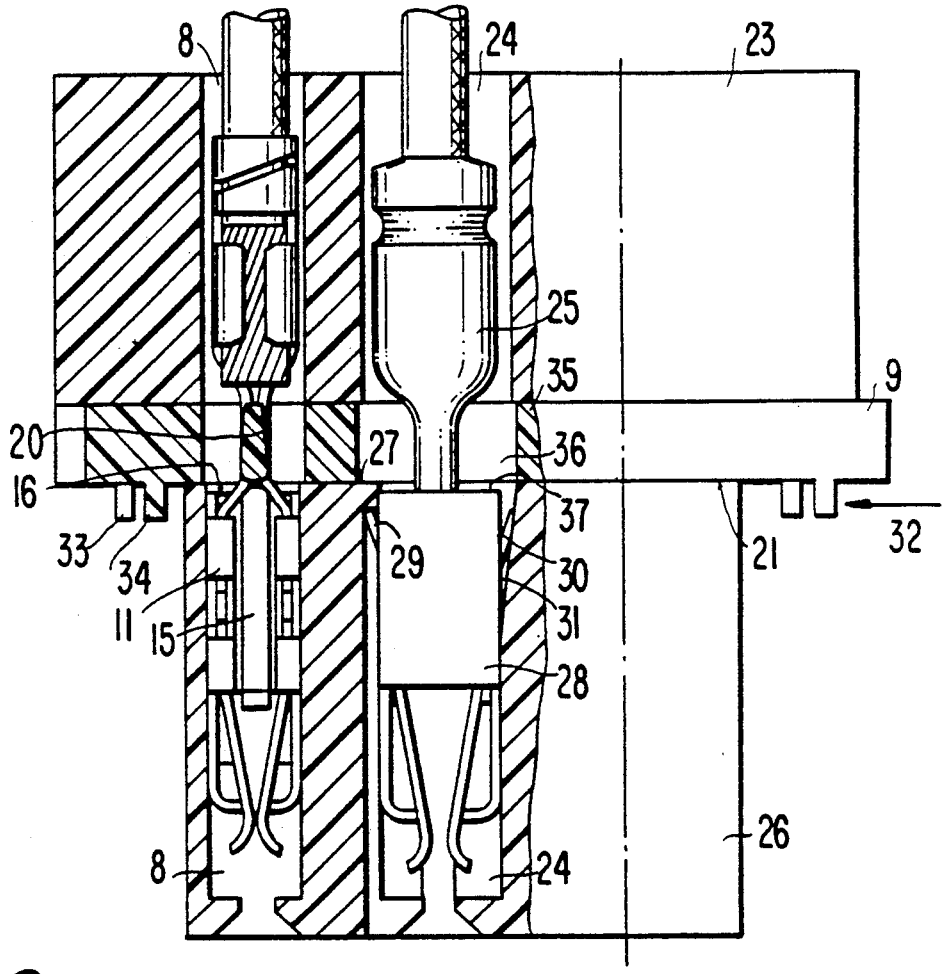
FIG. 8 shows a cross section through a second embodiment example of the contact carrier with a row of smaller flat contact receptacles and two rows of larger flat contact receptacles in the unlocking position of the safety plate.

The second embodiment example of a contact carrier 23 according to FIG. 8 has, in addition to a row of flat chambers 8 with the small flat contact receptacles 11, two rows with flat chambers 24, only one of which is indicated, which rows extend parallel to the first row. The chambers 24 are constructed so as to be larger in order to receive larger flat contact receptacles 25 than the flat contact receptacles 11. The portion of the chamber 24 in the lower part 26 of the contact carrier 23 can therefore be provided with an undercut 27, behind which a first catch tongue 29 engages, which first catch tongue 29 projects forward at a wall of the box-shaped portion 28 of the flat contact receptacle 25. Accordingly, the larger flat contact receptacle 25 is held in contact carrier 23 in the unlocking position of the plate 9. A second catch tongue 30 at the box-shaped portion 28 is supported at the wall of the chamber 24 located opposite the undercut 27. The wall can be provided with an insertion bevel 31 in its end portion facing the plate 9.

In order to lock the flat contact receptacles 11 and 25, the plate 9 is pushed transversely relative to the rows of flat chambers 8 and 24 in the direction of arrow 32 until the fixing tabs 33 and 34 contact one another at the upper part of the contact carrier 23 and at the plate 9. The smaller flat contact receptacle 11 is then securely held again in the contact carrier 23 by means of the plate side 21 contacting portions of the edge 16 of the box-shaped portion 13. The larger flat contact receptacles 25 are secured by means of the plate 9 in addition to the catching at the undercut 27 of the lower part 26 of the contact carrier 23. An edge portion 35 of the opening 36 of the plate 9 lies with the side 21 on an edge portion 37 of the box-shaped portion 28 of the larger flat contact receptacle 25. The edge portion 35 lies opposite the undercut and accordingly also overlaps the second catch tongue 30 of the flat contact receptacle 25. The larger flat contact receptacle 25 is accordingly likewise held in the contact carrier 23 so as to be secured against tilting.

The larger flat chambers 24 for the larger flat contact receptacles 25 can also be produced more easily with an undercut 27, since there is more room and the tools for this purpose are therefore cruder and accordingly more manageable and less needful of repair.

Figure 9:
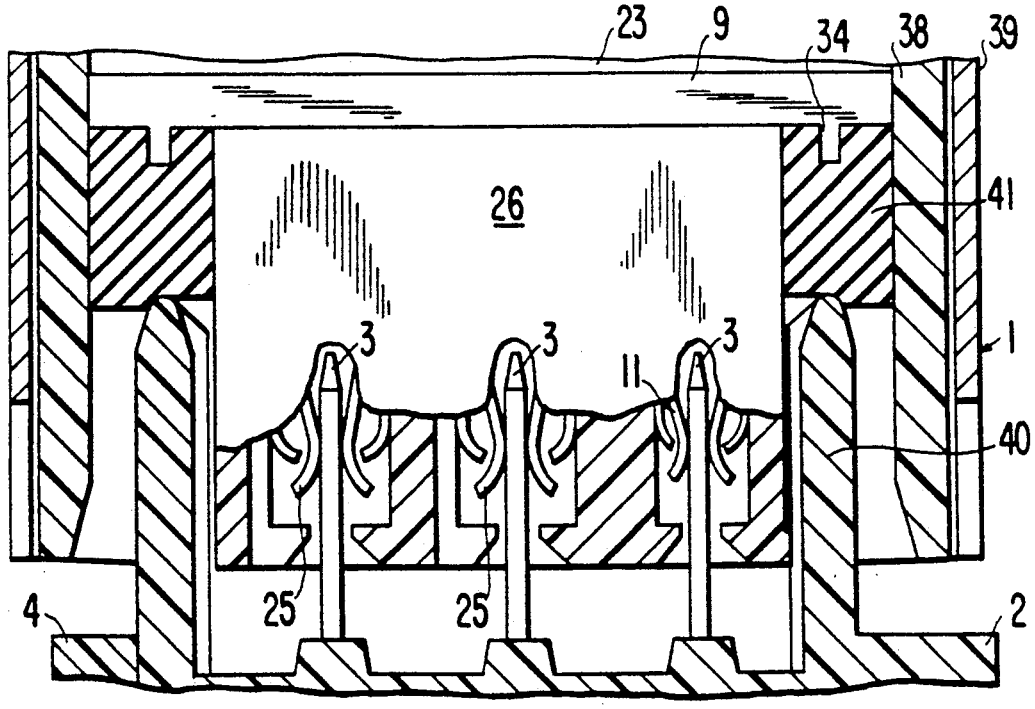
FIG. 9 shows a partial cross section through a multiconnection plug and socket with the contact carrier according to FIG. 8 in which a row of smaller flat contact receptacles and two rows of larger flat contact receptacles are arranged.

The partial cross section through a part of a multi-connection plug and socket shown in FIG. 9 shows the contact carrier 23 with a row of small flat contact receptacles 11 and with two rows of larger flat contact receptacles 25. The contact carrier 23, 26 with the safety plate 9 in the locking position is inserted in a housing 38 of insulating plastic. A clip 39 of an auxiliary device for locking or unlocking the socket 1 at the plug strip 2, also engages over the housing 38. The plug strip 2 has a receptacle edge 40 surrounding the plug-in area and projecting out over the flat plug-in contacts 3. A sealing ring 41 surrounding the lower part 26 is also inserted into the housing 38 of the socket 1 and contacts the safety plate side 21. When the socket 1 is plugged into the receptacle edge 40 of the plug strip 2, the flat plug-in contacts 3 are inserted into the assigned contact receptacles 11; 25. The lower part 26 of the contact carrier 23 is pushed into the receptacle edge 40 of the plug strip 2 for this purpose. The receptacle edge 40 contacts the sealing ring 41 of the socket 1 so as to seal.

Instead of the contact carrier 26, in which different sizes of flat contact receptacles 25 are inserted so as to be arranged in rows according to size, the contact carrier 5 can be arranged in the socket 1 so as to be outfitted only with the small flat contact receptacles 11.

Figure 10:
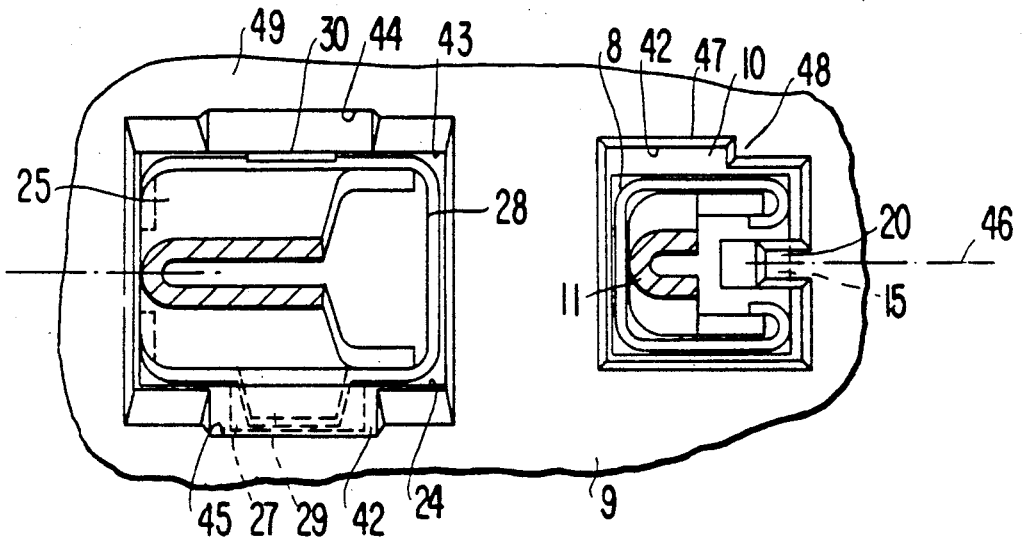
FIG. 10 shows a third embodiment example of the contact carrier with a partial cross section through a row of smaller and larger flat contact receptacles arranged in a mixed manner and illustrated in the unlocking position of the safety plate.

In addition, the flat contact receptacles 11 and 25 which are arranged in a plurality of rows in the contact carrier can be mixed within the rows, i.e. can be of different sizes, since the locking movement of the plate 9 is always effected transversely relative to the rows of the flat contact receptacles 11 and 25. This is shown as a third embodiment example in FIGS. 10 and 11 in a partial section through a contact carrier 42 at the upper side of the safety plate 9 in its unlocking and locking positions. A smaller flat chamber 8 and a a larger flat chamber 24 are constructed in a row in the contact carrier 42. The chamber 24 is again provided with the undercut 27, behind which the spring tongue 29 of the larger flat contact receptacle 25 inserted into the chamber 24 engages.

The plate 9 has a cut out portion 44 and 45, respectively, at two opposite sides of the opening 43 for the larger flat contact receptacle 25. The cut out portions 44 and 45 are constructed in the sides of the opening 43 which extend parallel to the center line 46 of the flat contact receptacles 11; 25. The cut out portions 44 and 45 serve as auxiliary inserting means for the catch tongues 29 and 30 at the box-shaped portion 28 of the flat contact receptacle 25.

The opening 10 in the plate 9 for the small flat contact receptacle 11 has a projection 48 at a side 42 extending parallel to the center line 46, which projection 48 projects into the opening 9 parallel to the side 42. In addition, the projection 20 projects into the opening 10. The catch tongue 15 of the small flat contact receptacle 11 again engages behind the projection 20 in the unlocking position of the plate 9.

Figure 11:
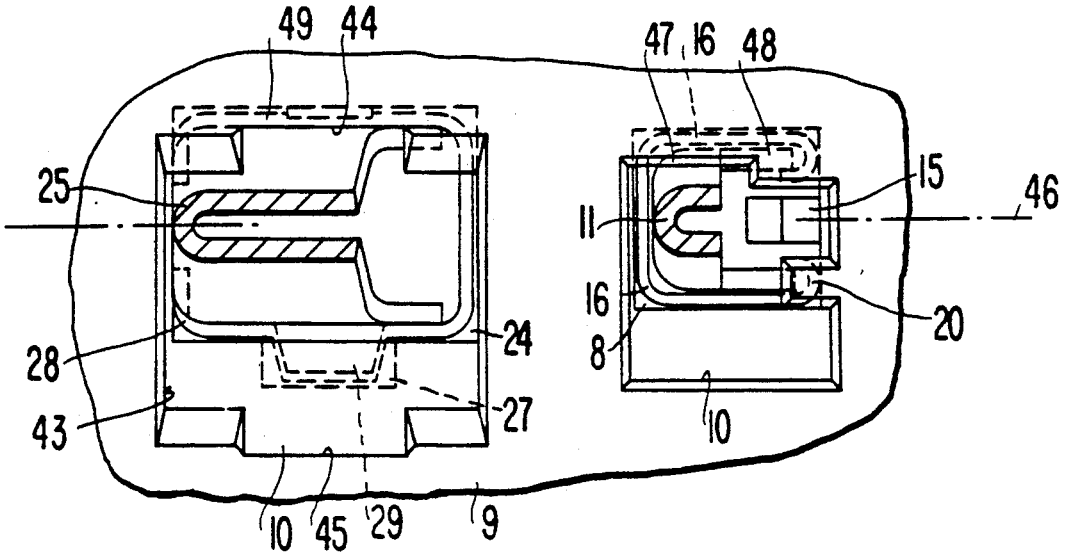
FIG. 11 shows the embodiment example according to FIG. 10 in the locking position of the plate.

In the locking position according to FIG. 11, the larger flat contact receptacle 25 is secured by means of the edge area 49 of the plate 9 bordering the opening 43 and surrounding the cut out portion 44, in addition to the catch tongue 29 contacting the undercut 27 of the contact carrier 42. The small flat contact receptacle 11 is secured by the projection 20 lying on a portion of the edge 16 of the box-shaped portion 13 and by the projection 48 lying on another portion of the edge 16 and by the edge area of the side 47 of the opening 10.

Finally, the larger flat contact receptacles 25 can also be secured solely by means of the plate 9 when projections at the plate 9 corresponding to the projections 20 and 47, 48 project into the opening 43 and the flat contact receptacles 25 are inserted into the spring contact chambers 24 in the position assigned to the projections.

We claim:

1. Multiconnection plug and socket comprising a plug strip which is provided with plug-in contacts, and a socket which includes a contact carrier having a plurality of parallel chambers, contact receptacles inserted into the flat chambers, respectively and each receptacle having a box-shaped portion formed with a resilient cantilivered catch tongue, the contact receptacles passing through assigned openings in a safety plate which is displaceable in the contact carrier transversely to the flat chambers, the safety plate having projections each projecting into one of the opening and a side of the safety plate facing in a plug-in direction of the socket lies substantially in the plane of end edges of respective said box-shaped portions, the safety plate being transversely displacedable between an unlocking position in which the catch tongues of the contact receptacles engage the projections in the chambers, and a locking position in which the plate side engages at least a part of respective said end edges of the box-shaped portions to safeguard the contact receptacles against tilting.

2. Plug and socket according to claim 1, characterized in that each plate opening (10), to which one said contact receptacle (11) is assigned, is adapted to the cross section of the box-shaped portion (13) of the assigned contact receptacle (11), and a respective said projection (20), which projects into the opening (10), is formed on a wall of the opening (10) and extends parallel to a locking direction of the plate (9), the catch tongue (15) of the assigned contact receptacle (11) engaging behind the projection (20) so as to contact the plate side (21) in the unlocking position of the plate (9).

3. Plug and socket according to claim 2, characterized in that each projection (20) contacts a portion of the edge (16) of the box-shaped portion (13) of the assigned contact receptacle (11) in the plate of the plate side (21) in the locking position of the plate (9), while an edge portion of the plate opening (10) contacts another portion of the edge (16) of the contact receptacle (11).

4. Plug and socket according to claim 2, characterized in that each plate opening (10) has a second projection (48) at a wall (47) extending transversely relative to the locking direction of the plate (9), which second projection (48) projects into the opening (10) and contacts a portion of the edge (16) of the box-shaped portion (13) of the assigned contact receptacle (11) in the plane of the plate side (21) in the locking position of the plate (9), which edge portion extends transversely to the locking direction of the plate (9), while another portion of the edge (16) contacts the plate side (21) behind the first mentioned projection (20) which projects into the opening (10) at a wall extending parallel to the locking direction.

5. Plug and socket according to claim 8, characterized in that the contact receptacles (11; 25) comprise at least two different sizes.

6. Plug and socket according to claim 5, characterized in that the larger and smaller contact receptacles (25; 11) contact the plate side (21) with their catch tongue (29; 15) in the unlocking position of the plate (9), wherein the catch tongues (29; 15) of the contact receptacles (25; 11) project transversely relative to a locking direction of the plate (9) at the box-shaped portions (28; 13) of the contact receptacles (25; 11).

7. Plug and socket according to claim 5, characterized in that the catch tongues (29) of the larger contact receptacles (25) project in a locking direction of the plate (9) portion (28) of the at least one larger receptacle (25) and are engaged at undercuts (27) of the contact carrier (23, 26; 42) in the unlocking and locking positions of the plate and the plate side (21) contacts the edge portions (49) of the box-shaped portions (28) in the locking position, while, in the unlocking position, the smaller contact receptacles (11) contact the plate side (21) with their catch tongues (15) projecting transversely relative to the locking direction and, in the locking position of the plate (9), portions of the plate side (21) contact the edge portions (16) of the box-shaped portions (13) of the smaller contact receptacles (11).

* * * * *